US007806192B2

(12) United States Patent
Foster et al.

(10) Patent No.: US 7,806,192 B2
(45) Date of Patent: Oct. 5, 2010

(54) METHOD AND SYSTEM FOR ANCHORING AND ISOLATING A WELLBORE

(76) Inventors: Anthony P. Foster, 1511 Mills Pass Way, Katy, TX (US) 77494; Basil J. Joseph, 4407 Oak Trail Ct., Sugar Land, TX (US) 77479

( * ) Notice: Subject to any disclaimer, the term of this patent is extended or adjusted under 35 U.S.C. 154(b) by 203 days.

(21) Appl. No.: 12/079,116

(22) Filed: Mar. 25, 2008

(65) Prior Publication Data

US 2009/0242214 A1 Oct. 1, 2009

(51) Int. Cl.
*E21B 33/128* (2006.01)

(52) U.S. Cl. ..... 166/387

(58) Field of Classification Search ..... 166/118, 166/120, 134, 387
See application file for complete search history.

(56) References Cited

U.S. PATENT DOCUMENTS 2,743,781 A * 5/1956 Lane ..... 166/212
2,970,651 A * 2/1961 Roberts ..... 166/212
3,085,627 A * 4/1963 Sodich ..... 166/120
5,220,959 A * 6/1993 Vance, Sr. ..... 166/187
5,542,473 A * 8/1996 Pringle ..... 166/120
6,009,951 A 1/2000 Coronado et al.
7,387,165 B2 * 6/2008 Lopez de Cardenas et al. ... 166/313
7,726,407 B2 * 6/2010 Wood et al. ..... 166/387
2005/0199401 A1 * 9/2005 Patel et al. ..... 166/387
2005/0284633 A1 * 12/2005 Richard ..... 166/278
2007/0289749 A1 12/2007 Wood et al.
2009/0173490 A1 * 7/2009 Dusterhoft et al. ..... 166/229

OTHER PUBLICATIONS

S. Yakeley, et al., Swellable Packers for Well Fracturing and Stimulation, Nov. 11, 2007, pp. 1-7, SPE 110621, Society of Petroleum Engineers, U.S.A.

* cited by examiner

*Primary Examiner*—William P Neuder
(74) *Attorney, Agent, or Firm*—Greenberg Traurig LLP; Anthony F. Matheny

(57) ABSTRACT

Downhole tools for anchoring and isolating at least one zone in a wellbore comprise a mandrel having an upper end, a lower end, an outer wall surface, and a longitudinal bore disposed therethrough having an axis. One or more anchors are disposed through the outer wall surface of the mandrel. Each of the anchors has a retracted position and an extended position. An isolation element is disposed along the outer wall surface of the mandrel. The isolation element may cover the anchors or be disposed, above, below, or around the anchors. Engagement of the isolation element with the inner wall surface of the wellbore to isolate at least one zone of the wellbore may be accomplished by piercing the isolation element to permit wellbore fluid to contact a swellable material contained within the isolation element, or by pumping fluid into the isolation element.

19 Claims, 6 Drawing Sheets

METHOD AND SYSTEM FOR ANCHORING AND ISOLATING A WELLBORE

BACKGROUND

1. Field of Invention

The invention is directed to downhole tools for anchoring wellbore tubulars and isolating at least one zone within the wellbore and, in particular, to downhole tools that secure a downhole tool string within the wellbore and isolate a zone within the wellbore.

2. Description of Art

Downhole tool string anchors and downhole isolation devices such as bridge plugs and packers are well known in the industry, each having been extensively used over a substantial number of years. In general, the downhole isolation devices are actuated subsequent to the setting of an anchor device that is included in the tool string either below or above the isolation device. One particular anchor system is disclosed in U.S. Patent Application Publication No. 2007/0289749, which is incorporated herein by reference in its entirety.

SUMMARY OF INVENTION

Broadly, downhole tools for use in downhole tool strings for securing the tool string within the wellbore and isolating at least one zone in the wellbore are disclosed. The downhole tools comprise a single mandrel that carries both the anchor element(s) and the isolation element to form a unitary downhole tool as opposed to two separate tools, i.e., one for anchoring and one for isolating. Therefore, the anchor and isolation elements can be disposed at the same point along the length of the tool string.

In one specific embodiment, the downhole tool includes a mandrel having a plurality of piston anchors and an isolation element disposed along an outer wall surface of the mandrel. In one particular embodiment, the piston anchors are telescoping comprising two or more telescoping members. In one specific embodiment, the isolation element covers each of the plurality of telescoping members when the downhole tool is at least in its run-in position. Upon disposing the downhole tool within the wellbore, fluid pressure pumped through the mandrel forces one or more of the plurality of telescoping members radially outward into the inner wall surface of the wellbore to secure the downhole tool and, thus, the tool string, within the wellbore. In so doing, one or more of the plurality of telescoping members pierce the isolation element. In other embodiments, the isolation element is not pierced by the piston or telescoping members. And, in still other embodiments, the isolation element is disposed around the pistons or telescoping members.

In addition to securing the tool string within the wellbore, the downhole tool seals or isolates at least one zone of the wellbore by contacting the isolation element with the inner wall surface of the wellbore. The isolation element may be contacted with the inner wall surface of the wellbore by, for example, forcing the isolation element into the inner wall surface of the wellbore; by inflating or expanding the isolation element with fluid; or by contacting the isolation element, or part of the isolation element with a fluid including liquids such as oil or water, contained within the wellbore or drilling fluid. In this last embodiment, the isolation element comprises swellable materials that, when contacted by the fluid, expand.

Figure 1:
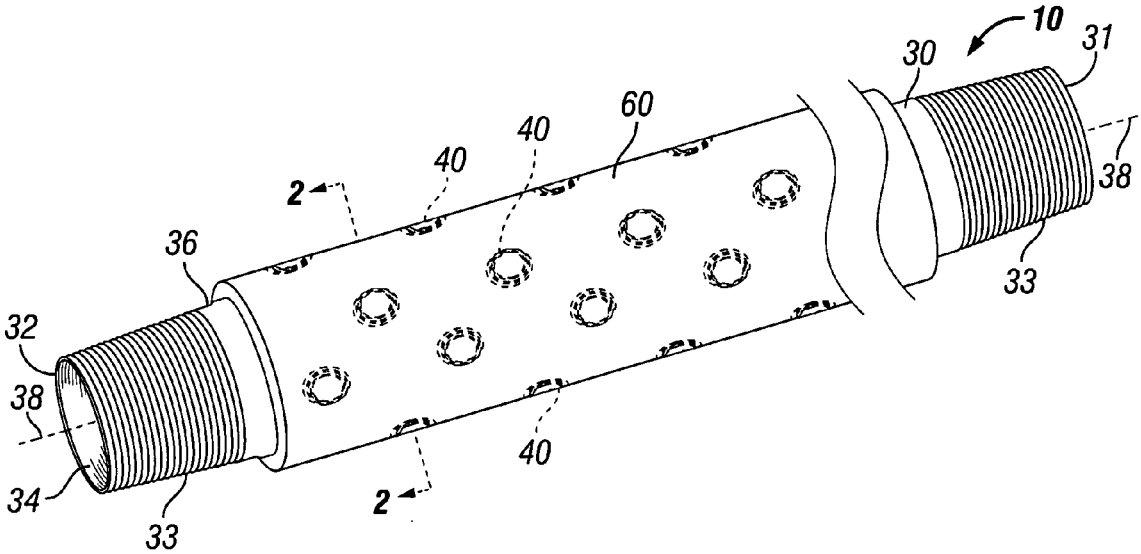
FIG. 1 is a perspective view of one specific embodiment of an anchor and isolation tool disclosed herein shown in the run-in position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-9, downhole tool 10 comprises mandrel 30 having upper end 31, lower end 32, bore 34, outer wall surface 36, axis 38, and a plurality of anchors 40 disposed in ports 39 of mandrel 30. Upper end 31 and lower end 32 may include fasteners such as threads 33 to facilitate securing downhole tool 10 to, and within, a downhole tool string (not shown).

Figure 2:
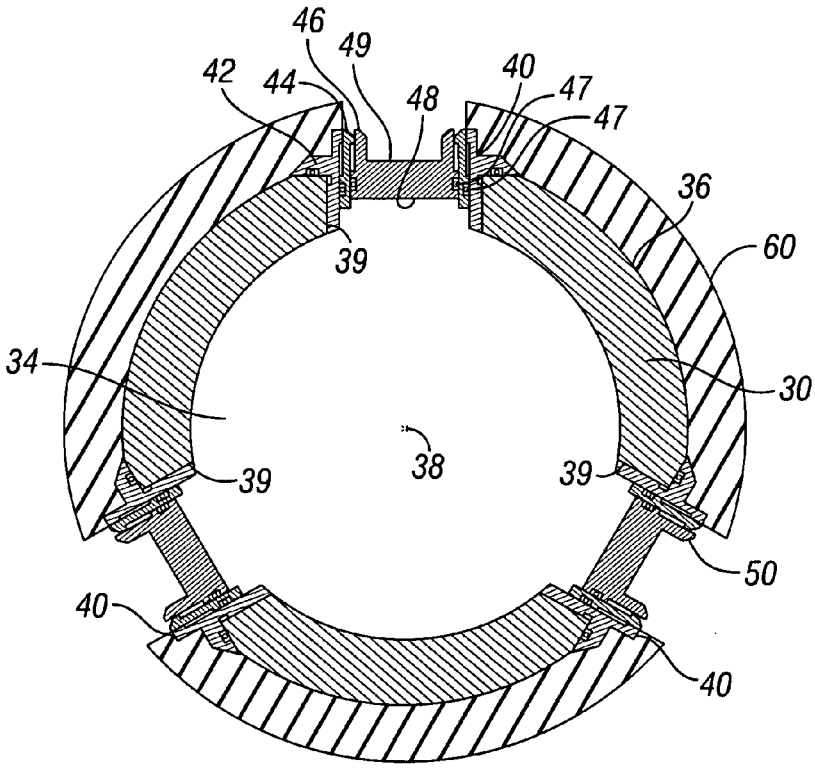
FIG. 2 is a cross-sectional view of the anchor and isolation tool shown in FIG. 1 taken along lines 2-2.
Figure 3:
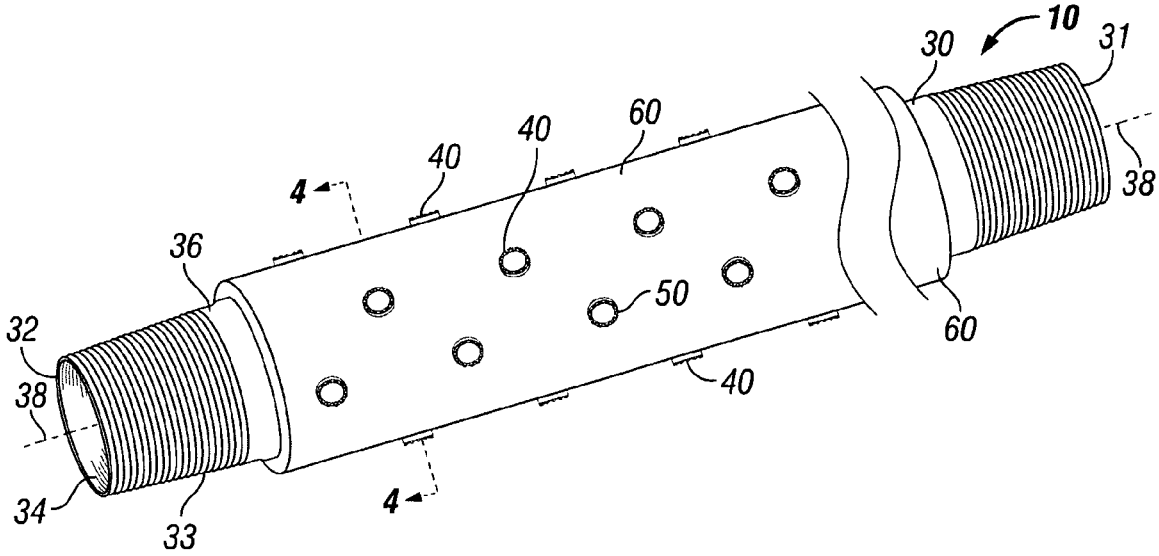
FIG. 3 is a perspective view of the anchor and isolation tool of FIG. 1 showing the anchors in the set position.
Figure 4:
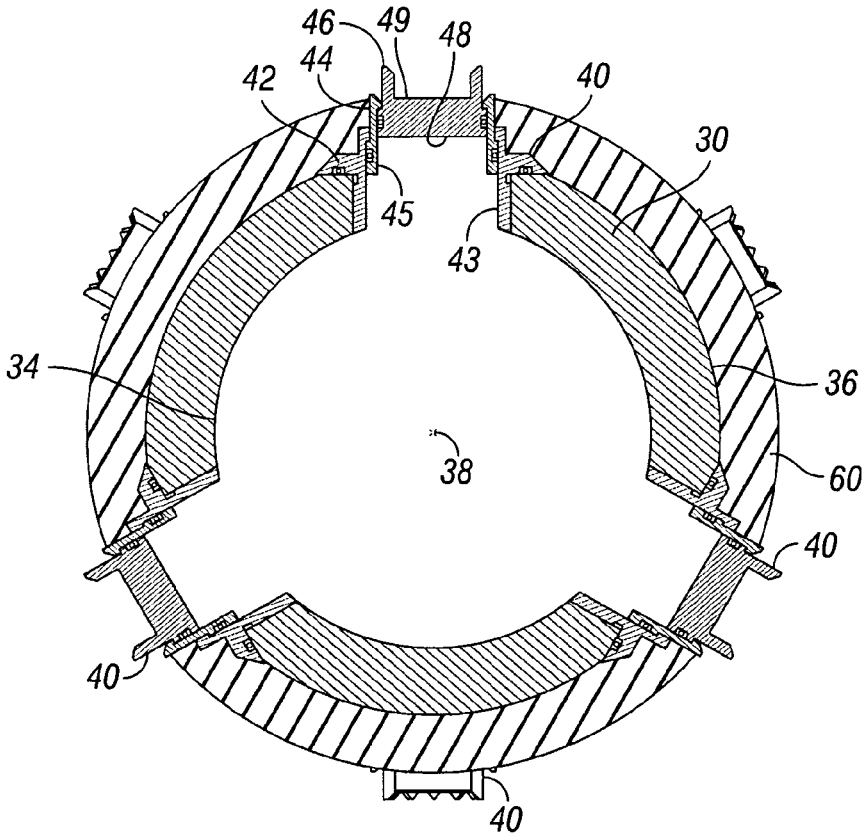
FIG. 4 is a cross-sectional view of the anchor and isolation tool shown in FIG. 3 taken along lines 4-4.
Figure 5:
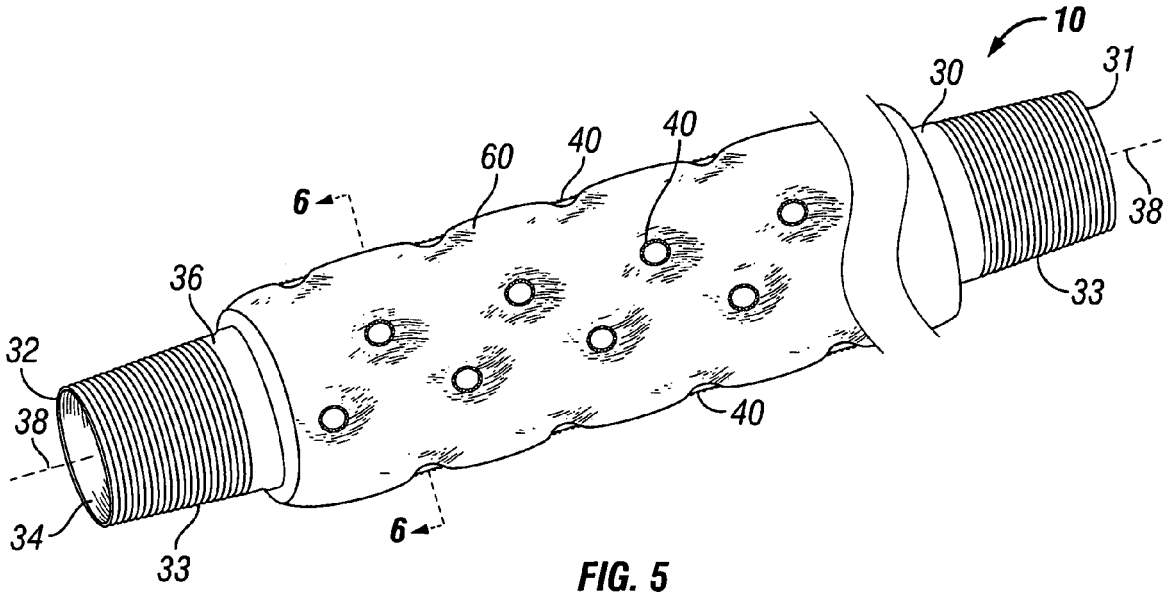
FIG. 5 is a perspective view of the anchor and isolation tool of FIG. 1 showing the anchors and the isolation element in the set position.
Figure 6:
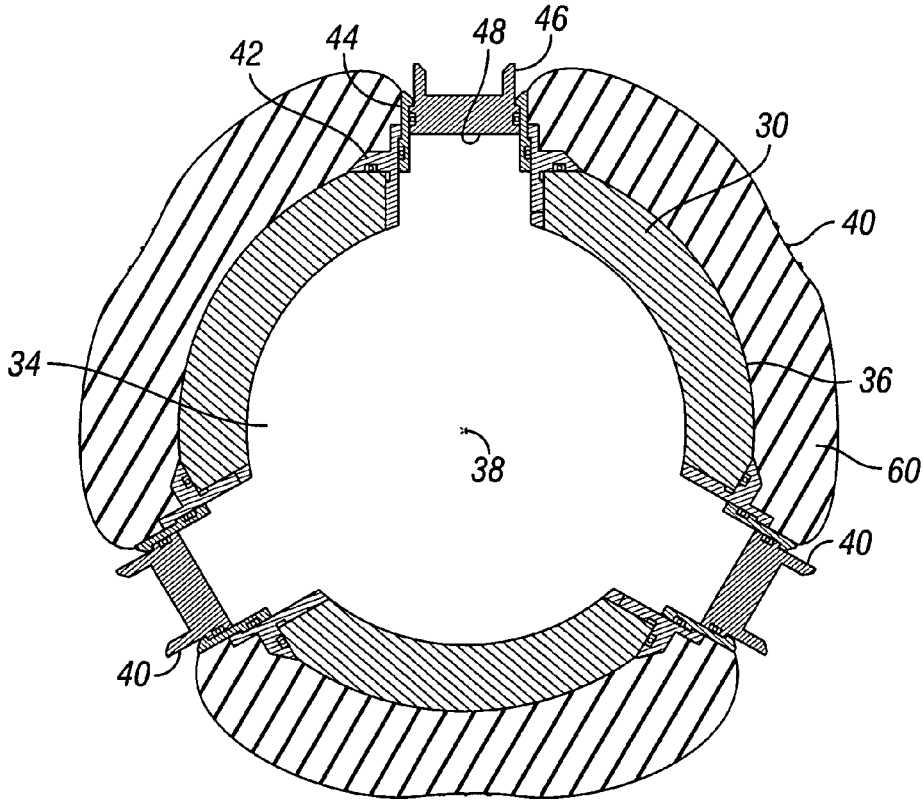
FIG. 6 is a cross-sectional view of the anchor and isolation tool shown in FIG. 5 taken along lines 6-6.

As shown in greater detail in FIGS. 2, 4, and 6, anchors 40 comprise pistons that permit each anchor 40 to be radially extended outwardly from axis 38. Although pistons can have numerous different designs, the pistons shown in the embodiment of FIGS. 1-9 comprise three telescoping members: stationary member 42 secured to mandrel 30; first telescoping member 44 having an outer wall surface in sliding engagement with an inner wall surface of stationary member 42; and second telescoping member 46 having an outer wall surface in sliding engagement with an inner wall surface of first telescoping member 44. Seals 47 reduce leakage along the sliding surfaces between stationary member 42, first telescoping member 44, and second telescoping member 46.

Stationary member 42 includes a bore 43 in communication with bore 34 for passage of fluid from bore 34 and through stationary member 42. First telescoping member 44 includes a bore 45 in fluid communication with the bore of stationary member 42 for passage of fluid from bore 34. Second telescoping member 46 includes a closed end comprising inner wall surface 48 and outer wall surface 49. Inner wall surface 48 is in fluid communication with the bore 45 of first telescoping member 44 that fluid can flow from bore 34, through the bore 43 of stationary member 42, through the bore 45 of first telescoping member 44, and against inner wall surface 48 of second telescoping member 46 to force second telescoping member 46 and, thus, first telescoping member 44 radially outward from axis 38.

Figure 7:
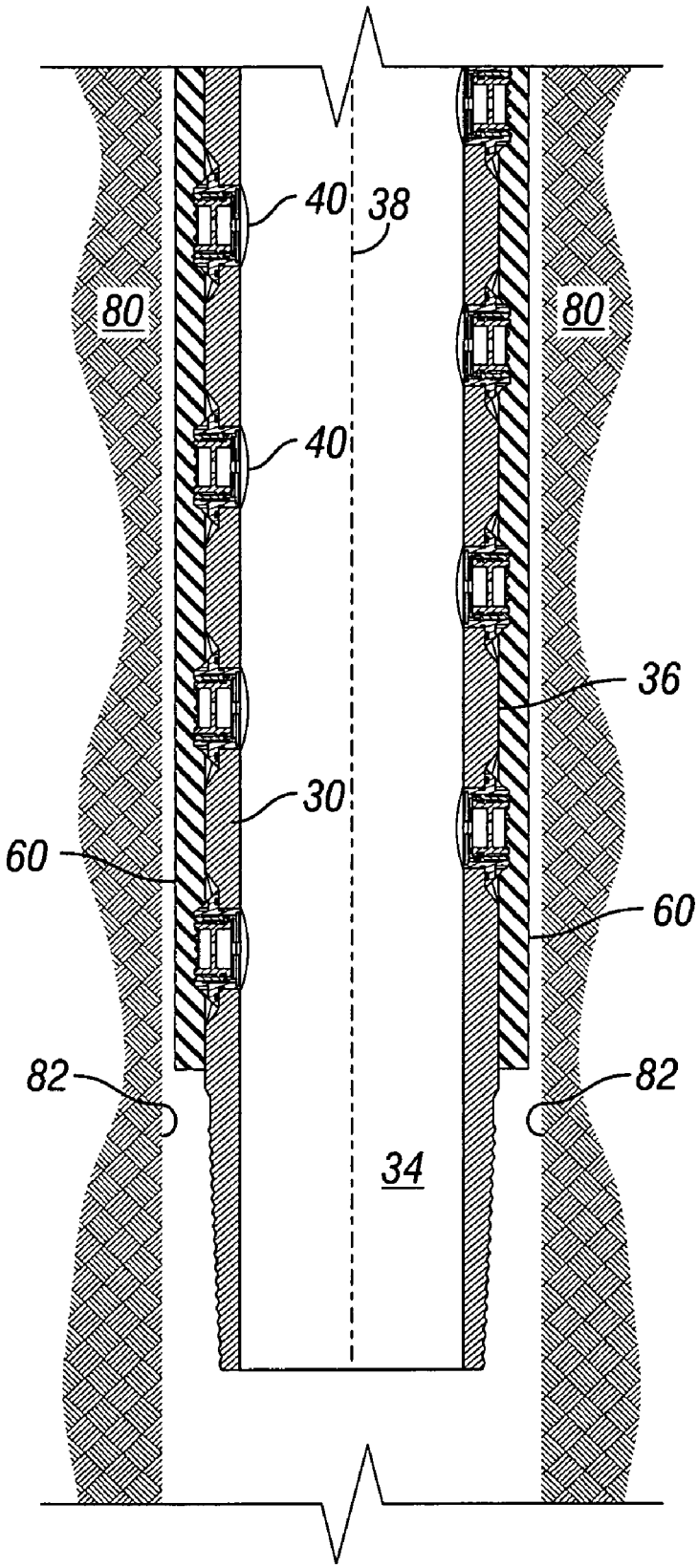
FIG. 7 is a cross-sectional view of one specific embodiment of an anchor and isolation tool disclosed herein shown in the run-in position.
Figure 8:
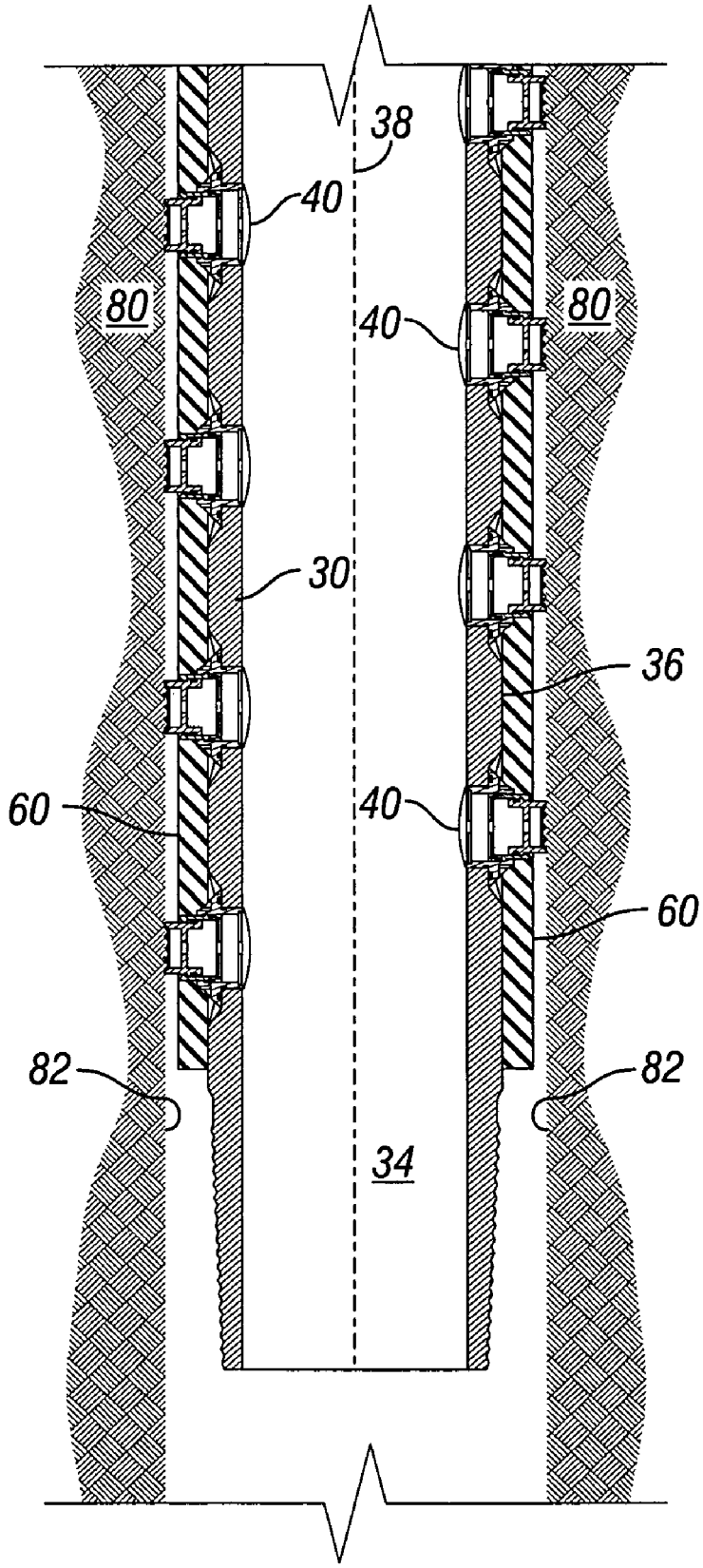
FIG. 8 is a cross-sectional view of the anchor and isolation tool of FIG. 1 showing the anchors in the set position.
Figure 9:
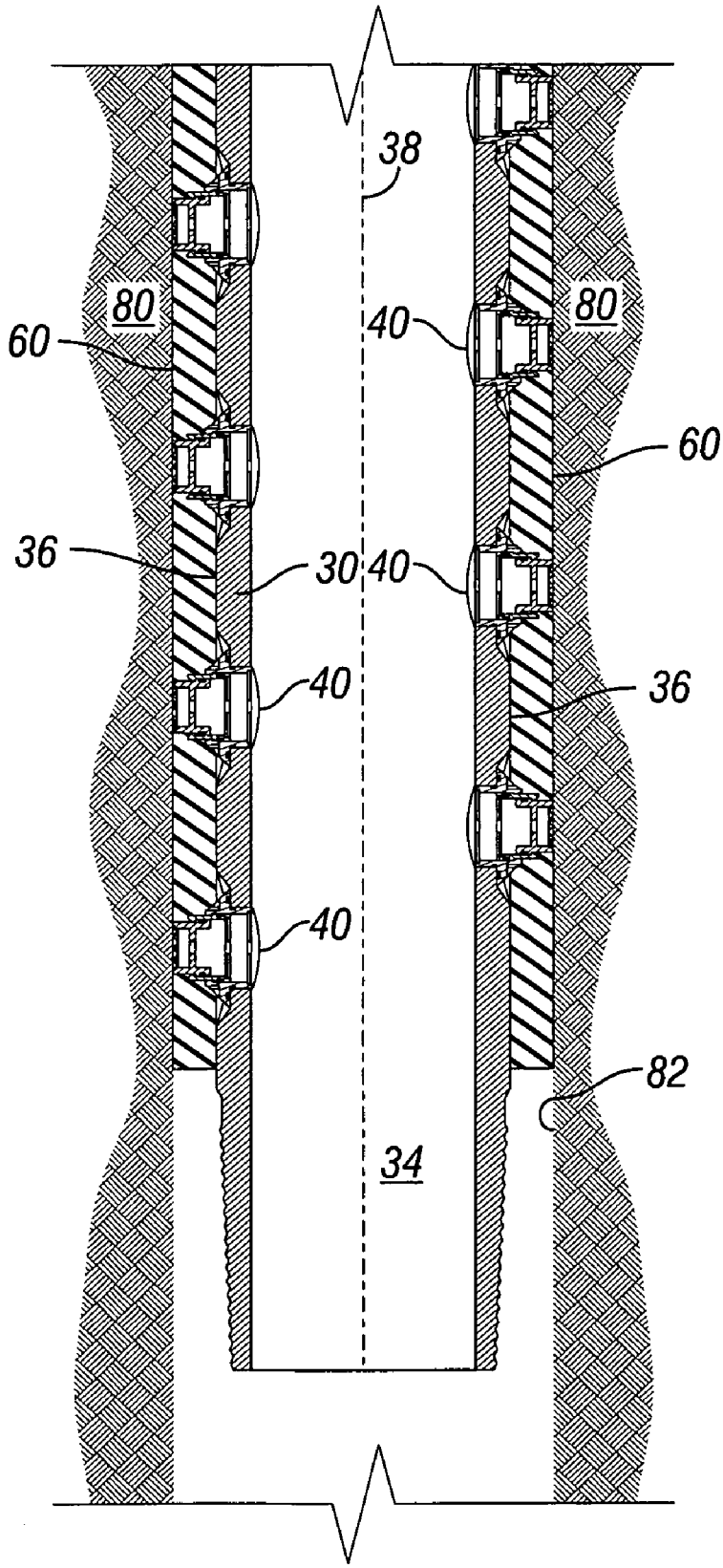
FIG. 9 is a cross-sectional view of the anchor and isolation tool of FIG. 1 showing the anchors and the isolation element in the set position.

In particular embodiments, second telescoping member 46 include one or more gripping profiles 50 at its outermost end, which may or may not be outer wall surface 49. The gripping profiles 50 may include wickers, teeth, or any other configuration that facilitates gripping profile 50 to grip or bite into inner wall surface 82 of wellbore 80 (FIGS. 7-9). Alternatively, gripping profile 50 may be profiled with grippers formed of carbide or other material, ball bearings, or spray-on grit surfaces, or any other material that facilitates increased friction or provides surface penetration of gripping profile 50 into inner wall surface 82. In one specific embodiment, gripping profile 50 is curved having the same curvature as inner wall surface 82 of wellbore 80. In another specific embodiment, gripping profile 50 is a cam surface causing a camming motion against inner wall surface 82.

As shown in the embodiments of FIGS. 1-9, gripping profile 50 of second telescoping member 46 comprises a recess so that gripping profile 50 is disposed around the circumference of an outermost rim of second telescoping member 46. Thus, as shown in FIGS. 1-9, gripping profile is not disposed on outer wall surface 49. It is to be understood, however, that the recess is not required and, if desired, outer wall surface 49 may be extended outwardly and gripping profile 50 may be disposed across outer wall surface 49 along the same plane on which gripping profile 50 is shown in the embodiment of FIGS. 1-9.

Stationary member 42 includes an upper shoulder and a lower shoulder disposed along the inner wall surface of stationary member 42 for engagement with a flange disposed on the outer wall surface of first telescoping member 44. Engagement of the lower shoulder of stationary member 42 with the flange of first telescoping member 44 restricts retraction of first telescoping member 44 toward axis 38 so that first telescoping member 44 remains contained within the bore of stationary member 42 (FIGS. 1, 2, and 7). Engagement of the upper shoulder of stationary member 42 with the flange of first telescoping member 44 restricts extension of first telescoping member 44 away from axis 38 (FIGS. 3-6 and 8-9).

First telescoping member 44 includes an upper shoulder disposed on the inner wall surface of first telescoping member 44 for engagement with a flange disposed on the outer wall surface of second telescoping member 46. Engagement of the upper shoulder of first telescoping member 44 with the flange of second telescoping member 46 restricts extension of second telescoping member 46 away from axis 38 (FIGS. 3-6 and 8-9).

First telescoping member 44 may also include a lower shoulder disposed on the inner wall surface of first telescoping member 44 for engagement with the flange disposed on the outer wall surface of second telescoping member 46. Engagement of the lower shoulder of first telescoping member 44 with the flange of second telescoping member 46 restricts retraction of second telescoping member 46 toward axis 38 so that second telescoping member 46 remains contained with the bore of first telescoping member 44 (FIGS. 1, 2, and 7).

In certain embodiments, the inner wall surface of stationary member 42 and the outer wall surface of first telescoping member 44 have a ratchet profile to restrict or prevent first telescoping member 44 from moving inwardly toward axis 38. Additionally, the inner wall surface of first telescoping member 44 and the outer wall surface of second telescoping member 46 may also have a ratchet profile to restrict or prevent second telescoping member 46 from moving inwardly toward axis 38.

Isolation element 60 is disposed on outer wall surface 36 of mandrel 30. Isolation element 60 may be disposed above, below, over, or around anchors 40. For example, as shown in FIGS. 1-9, isolation element 60 is disposed over anchors 40 toward lower end 32, but no anchors 40 are present toward upper end 31 so that isolation element 60 is disposed over some anchors 40 and above all of anchors 40. Alternatively, isolation element 60 may have holes (not shown) disposed there-through that are aligned with one or more anchors 40 so that anchors 40 can pass through isolation element 60 to engage inner wall surface 82 of wellbore 80 (FIGS. 7-9).

In one embodiment, isolation element 60 is an elastomeric or rubber element affixed to outer wall surface 36 using an appropriate adhesive. Although, isolation element 60 may be formed out of any material known to persons of ordinary skill in the art, in certain embodiments, isolation element 60 is a resilient, elastomeric or polymeric material of a commercially available type that will withstand high temperatures that occur in some wells. For example, isolation element 60 may be a perfluoro elastomer, a styrene-butadiene copolymer, neoprene, nitrile rubber, butyl rubber, polysulfide rubber, cis-1,4-polyisoprene, ethylene-propylene terpolymers, EPDM rubber, silicone rubber, polyurethane rubber, or thermoplastic polyolefin rubbers. In certain embodiments, the durometer hardness of isolation element 60 is in the range from about 60 to 100 Shore A and more particularly from 85 to 95 Shore A. In one embodiment, the durometer hardness is about 90 Shore A.

Other suitable materials for isolation element 60 include Teflon® (polytetrafluroethylene or fluorinated ethylene-propylene) and polyether ether ketone. For lower temperature wells, isolation element 60 could be nitrile rubber or other lower temperature conventional materials. For higher temperature wells, isolation element 60 may be any other thermoset material, thermoplastic material, or vulcanized material, provided such sealing materials are resilient and capable of withstanding high temperatures, e.g., greater than 400° F.

In other embodiments, isolation element 60 can be any known expandable or inflatable component known in the industry. For example, isolation element 60 may be formed out of any of the foregoing materials to form an inflatable elastomeric bladder capable of expansion by pumping fluid, e.g., wellbore fluid or hydraulic fluid, into the bladder. In such an embodiment, a fluid communication passage may be established between the interior of the elastomeric bladder and a fluid source, such as bore 34 or by a separate fluid communication passage may be included as part of downhole tool 10.

Alternatively, isolation element 60 may be an elastomeric bladder having one or more swellable materials generally known in the art disposed within the bladder. Alternatively, isolation element 60 itself may be partly or completely formed of one or more swellable materials.

The swellable materials, when placed in contact with a fluid, such as a hydrocarbon gas or liquid, or water, expand their size causing the elastomeric bladder to expand to engage inner wall surface 82 of wellbore 80 and, thus, isolate at least one zone in wellbore 80. In such an embodiment, isolation element 60 may include a device to restrict the activating fluid from contacting the swellable material until expansion of isolation element 60 is desired. In one particular embodiment, isolation element 60 is pierced by anchors 40 during extension of anchors 40 so that wellbore fluid flows into isolation element 60 and contact the swellable materials.

Suitable swellable materials include urethane and polyurethane materials, including polyurethane foams, biopolymers, and superabsorbent polymers. In one embodiment, the swellable materials swell by absorbing fluids such as water or hydrocarbons. Nitriles and polymers sold as 1064 EPDM from Rubber Engineering in Salt Lake City, Utah are acceptable swellable materials. In another embodiment, the swellable material comprises a swellable polymer such as cross-linked or partially cross-linked polyacrylamide, polyurethane, ethylene propylene, or other material capable of absorbing hydrocarbon, aqueous, or other fluids, and, thus, swelling to provide the desired expansion. In another embodiment, the swellable material is a shape-memory material, for example, a metal shape-memory material or a compressed elastomer or polymer that is held in the compressed state by a dissolvable material such as those discussed in the following paragraphs.

In one embodiment, the swellable materials may be encapsulated with a layer of material dissolvable by fluids such as water or hydraulic fluid. As used herein, the term "encapsulated" and "encapsulating" means that the dissolvable material forms an initial barrier between the fluid and the swellable materials. In such embodiments, the encapsulated layer allows the use of swellable materials that expand virtually instantaneously upon contacting the fluid by protecting the swellable materials until expansion is desired.

Encapsulating dissolvable materials for encapsulating the swellable materials may be any material known to persons of ordinary skill in the art that can be dissolved, degraded, or disintegrated over an amount of time by a temperature or fluid such as water-based drilling fluids, hydrocarbon-based drilling fluids, or natural gas. Preferably, the encapsulating dissolvable material is calibrated such that the amount of time necessary for the dissolvable material to dissolve is known or easily determinable without undue experimentation. Suitable encapsulating dissolvable materials include polymers and biodegradable polymers, for example, polyvinyl-alcohol based polymers such as the polymer HYDROCENE™ available from Idroplax, S.r.l. located in Altopascia, Italy, polylactide ("PLA") polymer 4060D from Nature-Works™, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material; polyethylene homopolymers and paraffin waxes; polyalkylene oxides, such as polyethylene oxides, and polyalkylene glycols, such as polyethylene glycols. These polymers may be preferred in water-based drilling fluids because they are slowly soluble in water.

In one specific embodiment having an encapsulating dissolvable material, the swellable material is one or more chemical components that undergo a chemical reaction when the swellable material is contacted with the fluid. For example, the swellable material may be a combination of solid particles of magnesium oxide and monopotassium phosphate encapsulated by one or more of the above-referenced encapsulating dissolvable materials. After the dissolution of the encapsulating dissolvable material, the chemical components of the swellable material react in the presence of the fluid, e.g., water or hydraulic fluid, causing the chemical components to form a gel phase and, ultimately, a crystallized solid ceramic material magnesium potassium phosphate hexahydrate which is a chemically bonded ceramic. In such embodiments, the encapsulating dissolvable material may also be used to separate one or more chemical component from one or more another chemical component to prevent premature reaction and expansion.

In selecting the appropriate swellable material and, if necessary or desired the encapsulating material, for isolation element 60, the amount of time necessary for downhole tool 10 to be run-in the wellbore and properly disposed for anchoring and isolating the wellbore should be taken into consideration. If the swellable materials expand prematurely, downhole tool 10 may not be properly set within the wellbore to isolate the desired zone or zones.

Isolation element 60 may be disposed on outer wall surface 36 of mandrel 30 such that one or more anchors 40 are covered such as illustrated in FIGS. 1-2. Alternatively, isolation element 60 may be designed such that holes are placed within isolation element 60 such that a hole in isolation element 60 is aligned with an anchor. In this embodiment, anchors 40 are permitted to extend radially outward through isolation element 60 to engage inner wall surface 82 of wellbore 80.

In operation of one specific embodiment, downhole tool 10 is secured to a tool string and lowered into a wellbore to the desired location. The wellbore may include a casing or may be an open-hole wellbore. Fluid is pumped down the tool string and into bore 34 and, thus, into the bores of stationary telescoping member 42 and first telescoping member 44 and against inner wall surface 48 of second telescoping member 46. The fluid builds up pressure within these areas and, thus, against inner wall surface 48 of second telescoping member 46 causing second telescoping member 46 to extend radially outward away from axis 38. As a result, the flange on the outer wall surface of second telescoping member 46 engages the upper shoulder on the outer wall surface of first telescoping member 44, causing first telescoping member 44 to extend radially outward away from axis 38 until gripping profile 50 of second telescoping member 46 engages with inner wall surface 82 of wellbore 80 (FIGS. 8 and 9).

In addition to extending anchors 40, isolation element 60 engages inner wall surface 82 of wellbore 80 to divide wellbore 80 and, thus, isolate at least one zone within in wellbore 80. As mentioned above, isolation element 60 may be expanded by contacting swellable materials contained within or as part of isolation element 60, by pumping fluid into isolation element 60, by moving or stretching isolation element 60 into engagement with inner wall surface 82 of wellbore 80, or through any other method of device known in the art. After isolation element 60 is expanded, at least one zone within wellbore 80 is isolated.

In one specific embodiment, anchors 40 are extended and secured to inner wall surface 82 of wellbore 80 before isolation element 60 engages inner wall surface 82 and at least one zone of wellbore 80 is isolated. In other specific embodiment, isolation element 60 engages inner wall surface 82 and at least one zone of wellbore 80 is isolated before extension of anchors 40. In an additional embodiment, anchors 40 are extended simultaneously with the engagement of isolation element 60 with inner wall surface 82.

In another specific embodiment, anchors 40 are extended causing isolation element 60 to be pierced. In one such embodiment, the piercing of isolation element 60 can permit wellbore fluid to enter isolation element 60 and contact swellable material contained therein. Upon contacting the wellbore fluid, the swellable material expands and, thus, isolation element 60 expands to engage inner wall surface 82 of wellbore and, thus, isolates at least one zone within wellbore 80.

In yet another specific embodiment, isolation element 60 is not pierced. Instead, wellbore fluid is permitted to contact the swellable material within isolation element 60 by breaking a rupture disk, by pumping fluid into isolation element or by using any other component of downhole tool 10 to puncture isolation element 60.

It is to be understood that the invention is not limited to the exact details of construction, operation, exact materials, or embodiments shown and described, as modifications and equivalents will be apparent to one skilled in the art. For example, anchors 40 may comprise a single telescoping member or more than two telescoping members. Moreover, the swellable materials as part of isolation element 60 may comprise water activated swellable materials, hydrocarbon swellable activated materials, or any other known swellable materials. In addition, the downhole tool may have a single anchor in which it is disposed completely around the circumference of the mandrel or partly around the circumference of the mandrel. Accordingly, the invention is therefore to be limited only by the scope of the appended claims.

What is claimed is:

1. A downhole tool comprising:

a mandrel having an upper end, a lower end, an outer wall surface, and a longitudinal bore disposed therethrough having an axis;

at least one anchor disposed through the outer wall surface, each of the at least one anchors having a retracted position, an extended position, and at least one telescoping member comprising an anchor bore and a closed end; and an isolation element disposed along the outer wall surface of the mandrel and around each of the at least one anchors to facilitate the isolation element being able to isolate at least one zone in a wellbore, wherein the mandrel, the at least one anchor and the isolation element are assembled to form a unitary downhole tool.

2. The downhole tool of claim 1, wherein the isolation element comprises at least one swellable material.

3. The downhole tool of claim 2, wherein the at least one swellable material is disposed within an elastomeric bladder.

4. The downhole tool of claim 1, wherein the isolation element encircles each of the at least one anchors.

5. The downhole tool of claim 1, wherein the isolation element is disposed over each of the at least one anchors.

6. The downhole tool of claim 1, wherein the telescoping members of each of the at least one anchors further comprise a stationary member, a first telescoping member, and a second telescoping member, the first telescoping member having an outer wall surface in sliding engagement with an inner wall surface of the stationary member and the second telescoping member having an outer wall surface in sliding engagement with an inner wall surface of the first telescoping member.

7. The downhole tool of claim 6, wherein the second telescoping member comprises the closed end, the closed end having a gripping profile disposed on an outer end surface.

8. The downhole tool of claim 1, wherein the downhole tool comprises a plurality of anchors spaced apart from each other and disposed circumferentially and longitudinally around the outer wall surface of the mandrel.

9. The downhole tool of claim 8, wherein the telescoping members of each of the at least one anchors comprise a stationary member, a first telescoping member, and a second telescoping member, the first telescoping member having an outer wall surface in sliding engagement with an inner wall surface of the stationary member and the second telescoping member having an outer wall surface in sliding engagement with an inner wall surface of the first telescoping member.

10. The downhole tool of claim 9, wherein the second telescoping member comprises the closed end, the closed end having a gripping profile disposed on an outer end surface.

11. The downhole tool of claim 10, wherein the isolation element comprises at least one swellable material.

12. The downhole tool of claim 11, wherein the at least one swellable material is disposed within an elastomeric bladder.

13. The downhole tool of claim 12, wherein the isolation element encircles each of the at least one anchors.

14. The downhole tool of claim 12, wherein the isolation element is disposed over each of the at least one anchors.

15. A method of anchoring and isolating at least one zone in a wellbore, the method comprising the steps of:

(a) disposing a unitary downhole tool comprising a mandrel, wherein the mandrel comprises an upper end, a lower end, an outer wall surface, a longitudinal bore disposed therethrough having an axis, a plurality of anchors spaced apart from each other and disposed circumferentially and longitudinally around the outer wall surface of the mandrel, each of the plurality of anchors comprising at least one telescoping member having an anchor bore and a closed end, the anchor bore being in fluid communication with the longitudinal bore, and an isolation element disposed along the outer wall surface of the mandrel and around each of the plurality of anchors to facilitate the isolation element being able to isolate at least one zone in a wellbore;

(b) lowering the unitary downhole tool to a desired location within a wellbore;

(c) extending each of the plurality of anchors by increasing pressure within the anchor bore and, thus, on the closed end of the at least one telescoping member until a sufficient number of the plurality of anchors engages an inner wall surface of the wellbore; and (d) engaging the isolation element with the inner wall surface of the wellbore.

16. The method of claim 15, wherein step (c) is performed before step (d).

17. The method of claim 15, wherein step (d) is performed before step (c).

18. The method of claim 15, wherein step (c) is performed simultaneously with step (d).

19. The method of claim 15, wherein step (d) is performed by piercing the isolation element with at least one of the anchors to permit wellbore fluid to contact a swellable material contained within the isolation element.

* * * * *